US005324606A

United States Patent [19]

Hodumi et al.

[11] Patent Number: 5,324,606

[45] Date of Patent: Jun. 28, 1994

[54] ELECTROPHOTOGRAPHIC PHOTORECEPTOR

[75] Inventors: Masahiko Hodumi; Masanori Murase; Sadao Okano; Koji Bando; Takahiro Suzuki; Seiji Ashiya, all of Minami Ashigara, Japan

[73] Assignee: Fuji Xerox Co., Ltd., Tokyo, Japan

[21] Appl. No.: 977,633

[22] Filed: Nov. 17, 1992

[30] Foreign Application Priority Data

Nov. 26, 1991 [JP] Japan ..... 3-335450
Aug. 6, 1992 [JP] Japan ..... 4-229391

[51] Int. Cl.[5] ..... G03G 5/047
[52] U.S. Cl. ..... 430/59; 430/58
[58] Field of Search ..... 430/58, 59, 69

[56] References Cited

U.S. PATENT DOCUMENTS 4,727,009 2/1988 Takai ..... 430/58
4,743,521 5/1988 Hoffmann et al. ..... 430/59
4,933,245 6/1990 Akasaki et al. ..... 430/58

FOREIGN PATENT DOCUMENTS 62-247374 10/1987 Japan .
2-293853 of 1990 Japan .

OTHER PUBLICATIONS

P. J. Meiz, et al., Photographic Science and Engineering, Mar./Apr. 1977, pp. 73–78.
Atsushi Kakuta, et al., IEEE Transactions on Industry Applications, Jul./Aug. 1981, pp. 382–386.

*Primary Examiner*—John Goodrow
*Attorney, Agent, or Firm*—Oliff & Berridge

[57] ABSTRACT

An electrophotographic photoreceptor comprising a conductive substrate having thereon a photosensitive layer as the uppermost layer, in which the photosensitive layer contains two charge transporting materials different in ionization potential, a charge transporting material having a higher ionization potential is present in the amount equimolar to or in an amount less than the equimolar amount to the other charge transporting material having a lower ionization potential. A laminate type electrophotographic photoreceptor comprising a conductive substrate having thereon a charge generating layer and a charge transporting layer, in which the charge generating layer comprises a binder resin and a charge generating material dispersed therein, the charge transporting layer comprises a binder resin and at least two charge transporting materials including a first charge transporting material and a second charge transporting material, the amount of the first charge transporting material is at least 60 wt % based on the total amount of the charge transporting materials, the difference between the highest ionization potential and the lowest ionization potential the charge transporting materials is not more than 0.4 eV, provided that (1) the ionization potentials of all the charge transporting materials are lower than the ionization potential of the charge generating material, or (2) the ionization potential of the first charge transporting material is lower than the ionization potential of the charge generating material, and the ionization potential of the second charge transporting material is higher than the ionization potential of the charge generating material by at least 0.2 eV.

9 Claims, 1 Drawing Sheet

ELECTROPHOTOGRAPHIC PHOTORECEPTOR

FIELD OF THE INVENTION

The present invention relates to an electrophotographic photoreceptor and a method for forming an electrostatic latent image on an electrophotographic photoreceptor.

BACKGROUND OF THE INVENTION

A separate function type (laminate type) electrophotographic photoreceptor having a laminate photosensitive layer composed of a charge generating layer and a charge transporting layer for performing the respective functions have undergone many improvements in charge retention, optical response, spectral characteristics, mechanical strength, and the like, and various proposals have been made with respect to the respective layers.

A charge transporting layer generally comprises a charge transporting material either alone or in combination with a film-forming binder resin. A number of charge transporting materials have been proposed to date, including pyrazoline compounds, hydrazone compounds, benzidine compounds, and polyvinylcarbazole compounds.

The separate function type electrophotographic photoreceptor is known to involve the following disadvantages upon repeated use: (1) They are susceptible to influences of corona charge products, such as ozone oxidation products, during charging processing, copying processing, etc. to cause an image blur. (2) Reductions in electrophotographic characteristics, such as an increase in residual potential and an increase in exposure potential (highlight potential), occur. It has therefore been demanded to overcome these problems.

In order to solve the above problems, an electrophotographic photoreceptor using two charge transporting materials, in which one has a higher ionization potential than that of the charge generating material and the other has a lower ionization potential than that of the charge transporting material, as in JP-A-2-293853. (The tern "JP-A" as used herein means an unexamined published Japanese patent application.)

SUMMARY OF THE INVENTION

An object of the present invention is to provide an electrophotographic photoreceptor with durability on repeated use and, in particular, an electrophotographic photoreceptor which, even when repeatedly used, causes no image blur and suffers from neither an increase in residual potential nor an increase in exposure potential.

Another object of the present invention is to provide an electrophotographic photoreceptor in that an image blur due to ozone and an image contamination due to insufficient cleaning are prevented, and the wear resistance of the charge transporting layer as the uppermost layer is improved.

Still another object of the present invention is to provide a method for forming an electrostatic latent image using the above electrophotographic photoreceptor.

Other objects and effects of the present invention will be apparent from the following description.

The present invention relates to, as a first aspect, an electrophotographic photoreceptor comprising a conductive substrate having thereon a photosensitive layer as the uppermost layer, in which the photosensitive layer contains two charge transporting materials different inionization potential, and a charge transporting material having a higher ionization potential is present in the amount equimolar to or in an amount less than the equimolar amount to the other charge transporting material having a lower ionization potential.

The first aspect of the present invention also relates to a method for forming an electrostatic latent image on an electrophotographic photoreceptor, which method comprises the steps of: charging the above-mentioned electrophotographic photoreceptor by means of an ozone-generating discharger; and imagewise exposing the charged photoreceptor to light.

The present invention also relates to, as a second aspect, a laminate type electrophotographic photoreceptor comprising a conductive substrate having thereon a charge generating layer and a charge transporting layer, in which the charge generating layer comprises a binder resin and a charge generating material dispersed therein, the charge transporting layer comprises a binder resin and at least two charge transporting materials including a first charge transporting material and a second charge transporting material, the amount of the first charge transporting material is at least 60 wt % based on the total amount of the charge transporting materials, the difference in ionization potential between the charge transporting material having the highest ionization potential and the charge transporting material having the lowest charge transporting material is not more than 0.4 eV, and the ionization potentials of all the charge transporting materials are lower than the ionization potential of said charge generating material.

The present invention also relates to, as a third aspect, a laminate type electrophotographic photoreceptor comprising a conductive substrate having thereon a charge generating layer and a charge transporting layer, in which the charge generating layer comprises a binder resin and a charge generating material dispersed therein, the charge transporting layer comprises a binder resin and at least two charge transporting materials including a first charge transporting material and a second charge transporting material, the amount of the first charge transporting material is at least 60 wt % based on the total amount of the charge transporting materials, the difference in ionization potential between the charge transporting material having the highest ionization potential and the charge transporting material having the lowest charge transporting material is not more than 0.4 eV, the ionization potential of the first charge transporting material is lower than the ionization potential of the charge generating material, and the ionization potential of the second charge transporting material is higher than the ionization potential of the charge generating material by at least 0.2 eV.

DETAILED DESCRIPTION OF THE INVENTION

The term "ionization potential" as used herein is defined in such a manner that a compound is irradiated with a light while varying its wavelength (i.e., energy), and the energy value at which the generation of photoelectrons begins is defined as the ionization potential.

An example of the measurement of ionization potential (hereinafter sometimes abbreviated as "Ip") is described below.

A sample of the compound to be measured in the form of powder is put in an aluminum pan (depth: 1 mm, diameter: 7 mm) and set in an Ip measuring device ("Surface Analyzer AC-1" produced by Riken Keiki Co., Ltd.) in such a manner that the distance between the surface of the sample powder and the ultraviolet irradiating position is 2 mm. The above Ip measuring device can analyze the surface of specimen by counting the number of photoelctrons generated by ultraviolet ray activation, using a low energy electron counter. The measurement is carried out under the following conditions:

Counting time: 10 seconds per 1 point.

Power of light: 50 $\mu W/cm^2$ (compensated by the program of the device).

Scanning range of energy: 3.4 to 6.2 eV.

Size of ultraviolet ray spot: 1 mm square.

Unit photoelectron: $1\times10^{10}$ per $cm^2$.second.

The Ip is calculated according to the program of the device for obtaining work function in such a manner that in the graph showing the relationship between the square root of the counted value (CPS) of photoelectrons and the ultraviolet ray activation energy, the straight part of the graph is extrapolated to intersect the background line, and the energy value corresponding to the intersection point is defined as the Ip.

Figure 3:
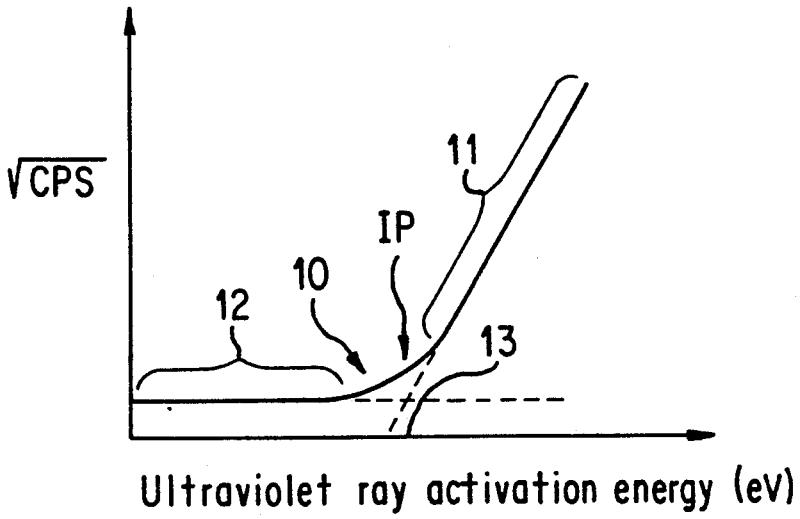
FIG. 3 is a graph showing the relationship between the square root of the counted value (CPS) of photoelectrons and the ultraviolet ray activation energy, which is used for determining the ionization potential.

FIG. 3 shows a specific example of the graph showing the relationship between the square root of the CPS and the ultraviolet ray activation energy (eV). Numeral 10 denotes a curve showing the relationship between the square root of the CPS and the ultraviolet ray activation energy (eV), 11 denotes a straight part of curve 10, 12 denotes a background part of curve 10, and 13 denotes a intersection point of the extrapolated lines of straight part 11 and background part 12. The ultraviolet ray activation energy (eV) corresponding to intersection point 13 is Ip.

It has been reported that the effective injection of the carrier generated in the charge generating layer into the charge transporting layer generally relates to the ionization potential of the charge transporting material, as disclosed, e.g., in *Photographic Science and Engineering*, vol. 21, p. 73 (1977) and *IEEE Trans*, vol. IA-17, p. 382. The ionization potential that is the most important factor in the effective injection of the carrier closely relates to the ionization potential of the charge generation material itself. However, in general, it is known that if the ionization potential of the charge generating material and that of the charge transporting material is close to each other, the electrophotographic properties are qualitatively improved.

However, in the present invention, at least two charge transporting materials are used, and (i) a charge transporting having a higher ionization potential is present in the amount equimolar to or in an amount less than the equimolar amount to the other charge transporting material having a lower ionization potential (first aspect of the present invention); (ii) the difference between the highest ionization potential and the lowest ionization potential of the transporting materials is not more than 0.4 eV, and all the ionization potentials of the charge transporting materials are lower than the ionization potential of the charge generating material (second aspect of the present invention); or (iii) the difference between the highest ionization potential and the lowest ionization potential of the transporting materials is not more than 0.4 eV, the ionization potential of the first charge transporting material is lower than the ionization potential of the charge generating material, and the ionization potential of the second charge transporting material being higher than the ionization potential of the charge generating material by at least 0.2 eV (third aspect of the present invention).

The electrophotographic photoreceptor according to the first aspect of the present invention comprises a conductor substrate having thereon a photosensitive layer as the uppermost layer. The photosensitive layer may have either a single layer structure or a multi-layer structure comprising a charge generating layer and a charge transporting layer. In the first aspect of the present invention, a photosensitive layer having the multi-layer structure is preferably employed.

The electrophotographic photoreceptors according to the second and third aspects of the present invention comprise a photosensitive layer having the multi-layer structure.

In the case of the single layer structure, the photosensitive layer contains a charge generating material and at least two charge transporting materials, and forms the outermost layer.

In the case of the multi-layer structure, the photosensitive layer comprises a charge generating layer containing a charge generating material, and a charge transporting layer. The charge transporting layer contains at least two charge transporting materials and forms the outermost layer.

The conductive substrate which can be used in the present invention is conventional. Examples thereof includes a metal pipe, a metal plate, a metal sheet, a metal foil, and a high polymer film or paper having been rendered electrically conductive, for example, a high polymer film having a metal deposit, e.g., aluminum, and a high polymer film or paper coated with a metal oxide (e.g., $SnO_2$) or a quaternary ammonium salt, etc.

Figure 1:
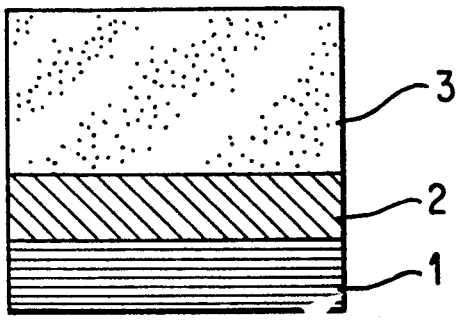
FIGS. 1 and 2 each illustrate a cross section of the electrophotographic photoreceptor according to the present invention.
Figure 2:
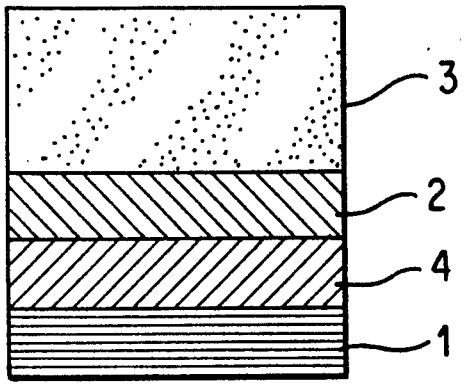

One preferred embodiment of the present invention will be explained in detail by referring to the accompanying drawing. In FIG. 1, conductive substrate 1 has laminated thereon charge generating layer 2 and charge transporting layer 3 in this order. In FIG. 2, conductive substrate 1 additionally has subbing layer 4 between conductive substrate 1 and charge generating layer 2 or charge transporting layer 3.

The laminating order of charge generating layer 2 and charge transporting layer 3 is not limited, but charge transporting layer 3 is preferably provided as an upper layer.

The charge generating layer can be formed of a charge generating material, if desired, as dispersed in a binder resin.

Examples of the charge generating materials include selenium or selenium alloys; inorganic photoconductive substances, e.g., Cds, CdSe, CdSSe, ZnO, and ZnS; metallo- or metal-free phthalocyanine pigments; azo pigments, such as bisazo pigments and trisazo pigments; squarylium compounds; azulenium compounds; perylene pigments; indigo pigments; polycyclic quinone pigments, such as quinacridone pigments; cyanine dyes; xanthene dyes; charge transfer complexes composed of, for example, poly-N-vinylcarbazole and trinitrofluorenone; and eutectic complexes composed of a pyrylium salt dye and a polycarbonate resin.

Specific examples of the charge generating material and their ionization potential are shown below.

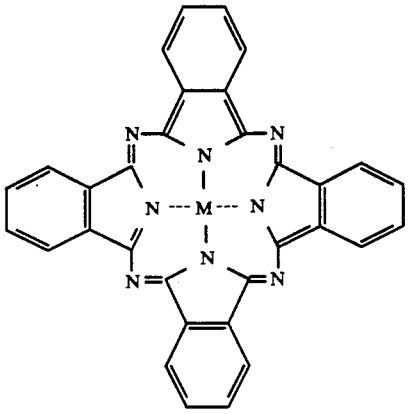

| | | |
|---|---|---|
| M = | Pb | 5.28 eV |
| | Tio | 5.38 eV |
| | H2 | 5.40 eV |
| | Cu | 5.20 eV |
| | ClIn | 5.22 eV |
| | Vo | 5.05 eV |

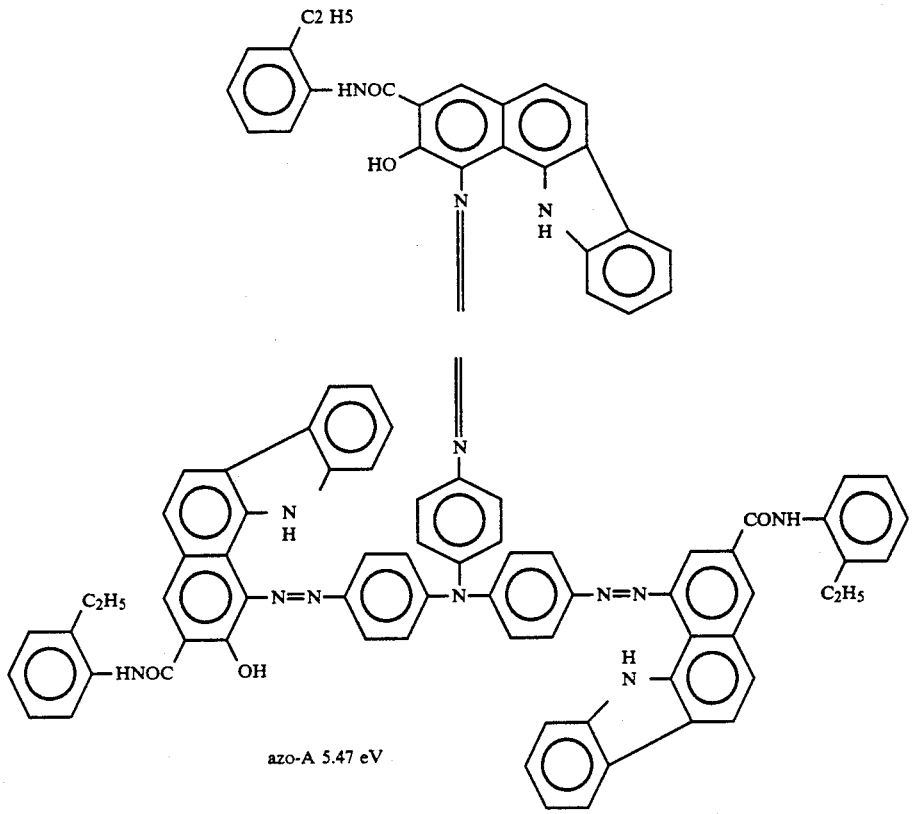

azo-A 5.47 eV

-continued

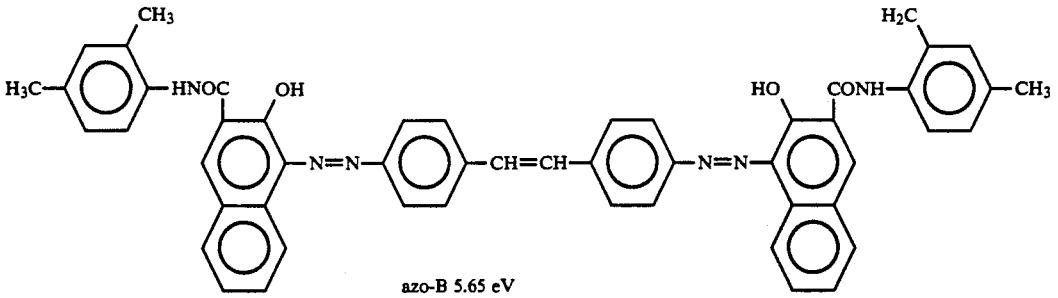

azo-B 5.65 eV

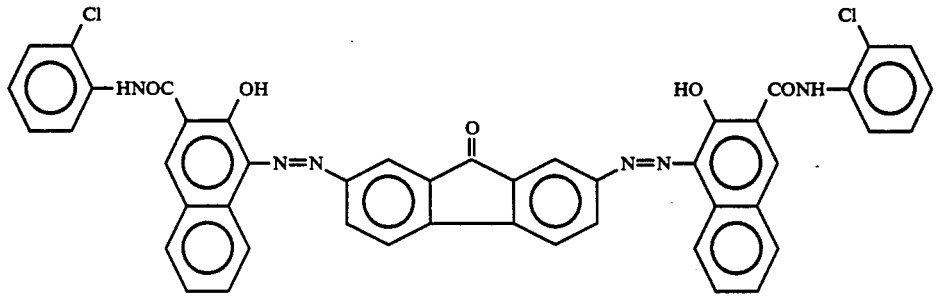

azo-C 5.92 eV

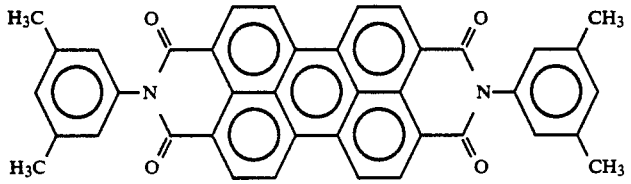

pery 5.83 eV

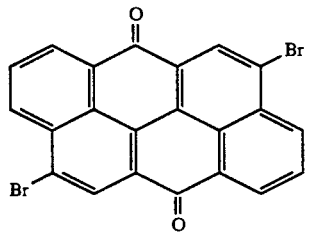

Ip = 5.44 eV

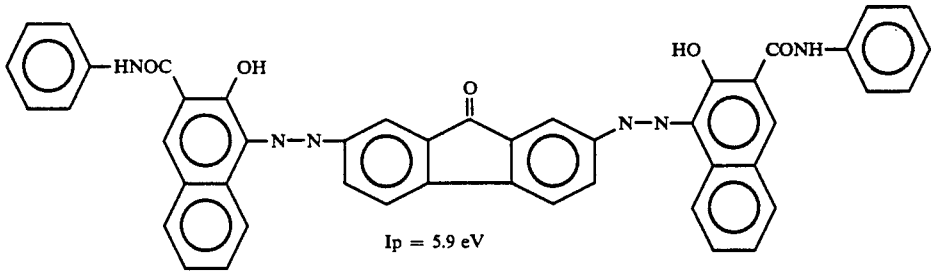

Ip = 5.9 eV

Binder resins to be used in the charge generating layer are conventional. Examples thereof include polycarbonate, polystyrene, polyester, polyvinyl butyral, methacrylic ester polymers or copolymers, vinyl acetate homo- or copolymers, cellulose esters or ethers, polybutadiene, polyurethane, and epoxy resins.

In the charge generating layer, the weight ratio of the charge generating material to the binder resin is generally from 40/1 to 1/20, preferably from 10/1 to 1/10.

The charge generating layer usually has a thickness of from 0.01 to 10 μm, preferably from 0.1 to 5 μm.

Charge transporting layer 3 according to the present invention comprises two charge transporting materials different in ionization potential and a binder resin.

In the first aspect of the present invention, the charge transporting material having a lower ionization potential preferably includes a benzidine compound represented by formula (I):

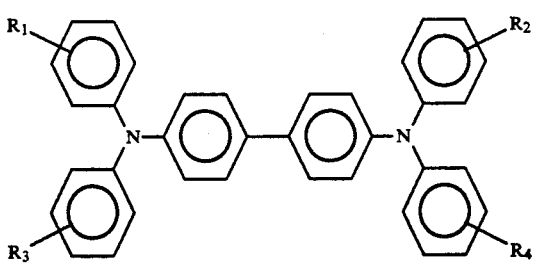

(I)

wherein $R_1$, $R_2$, $R_3$, and $R_4$ each represent a hydrogen atom, an alkyl group, an alkoxy group, a halogen atom, an alkoxycarbonyl group, or a substituted amino group, and the other having a higher ionization potential preferably includes a benzidine compound represented by formula (II):

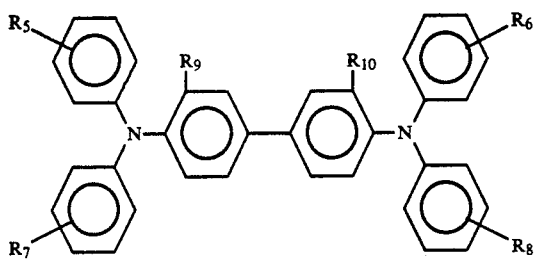

(II)

wherein $R_5$, $R_6$, $R_7$, and $R_8$ each represent a hydrogen atom, an alkyl group, an alkoxy group, a halogen atom, an alkoxycarbonyl group, or a substituted amino group; and $R_9$ and $R_{10}$ each represent an alkyl group or an alkoxy group.

Examples of the compound represented by formula (I) are shown in Table 1 below.

TABLE 1

| Compound No. | $R_1$ | $R_2$ | $R_3$ | $R_4$ |
|---|---|---|---|---|
| (1) | H | H | m-$CH_3$ | m-$CH_3$ |
| (3) | p-$CH_3$ | p-$CH_3$ | p-$C_2H_5$ | p-$C_2H_5$ |
| (4) | H | H | p-$C_2H_5$ | p-$C_2H_2$ |
| (5) | m-$OCH_3$ | m-$OCH_3$ | H | H |
| (6) | o-$CH_3$ | o-$CH_3$ | H | H |
| (7) | p-$CH_3$ | p-$CH_3$ | H | H |
| (8) | o-Cl | o-Cl | H | H |
| (9) | p-Cl | p-Cl | H | H |
| (10) | m-Cl | m-Cl | H | H |
| (11) | p-$CH_3$ | p-$CH_3$ | p-$CH_3$ | p-$CH_3$ |
| (12) | p-$CH_3$ | p-$CH_3$ | p-$C_3H_7$ | p-$C_3H_7$ |

Specific examples of the compound represented by formula (II) are shown in Table 2 below.

TABLE 2

| Compound No. | $R_5$ | $R_6$ | $R_7$ | $R_8$ | $R_9$ | $R_{10}$ |
|---|---|---|---|---|---|---|
| (2) | p-$CH_3$ | p-$CH_3$ | p-$C_2H_5$ | p-$C_2H_5$ | $CH_3$ | $CH_3$ |
| (13) | p-$CH_3$ | p-$CH_3$ | p-$CH_3$ | p-$CH_3$ | $CH_3$ | $CH_3$ |
| (14) | H | H | p-$CH_3$ | p-$CH_3$ | $CH_3$ | $CH_3$ |
| (15) | p-$CH_3$ | p-$CH_3$ | m-$CH_3$ | m-$CH_3$ | $CH_3$ | $CH_3$ |
| (16) | H | H | o-$CH_3$ | o-$CH_3$ | $CH_3$ | $CH_3$ |
| (17) | H | H | m-$CH_3$ | m-$CH_3$ | $CH_3$ | $CH_3$ |
| (18) | p-$C_2H_5$ | p-$C_2H_5$ | p-$C_2H_5$ | p-$C_2H_5$ | $CH_3$ | $CH_3$ |
| (19) | H | H | p-$CH_3$ | p-$CH_3$ | $C_2H_5$ | $C_2H_5$ |
| (20) | H | H | p-$C_2H_5$ | p-$C_2H_5$ | $C_2H_5$ | $C_2H_5$ |

Specific examples of the charge generating material used in the second and third aspect of the present invention and their ionization potentials are shown below.

(1) Hydrazone Compound (Compound 1-A)

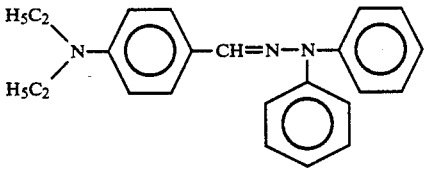

Ip = 5.23 eV (Compound 1-B)

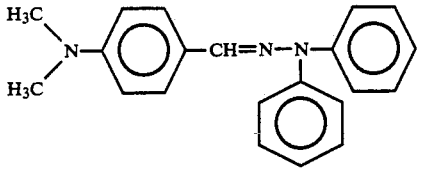

Ip = 5.28 eV (Compound 1-C)

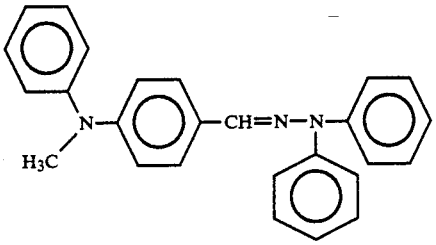

Ip = 5.47 eV

-continued
(Compound 1-D)
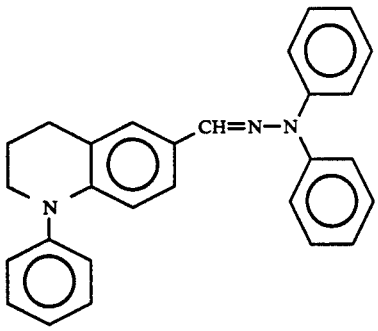
Ip = 5.50 eV
(Compound 1-E)
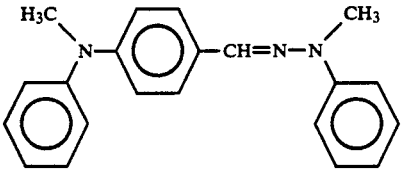
Ip = 5.38 eV
(Compound 1-F)
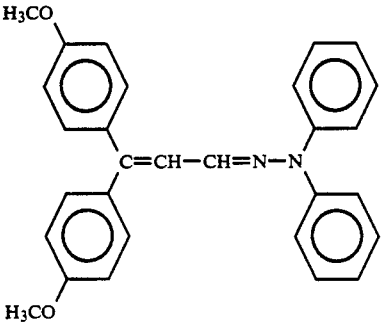
Ip = 5.35 eV
(Compound 1-G)
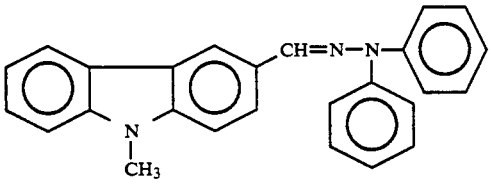
Ip = 5.28 eV
(2) Styryltriphenylamine Compound
(Compound 2-A)
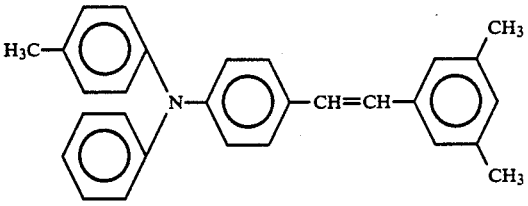
Ip = 5.42 eV
(Compound 2-B)
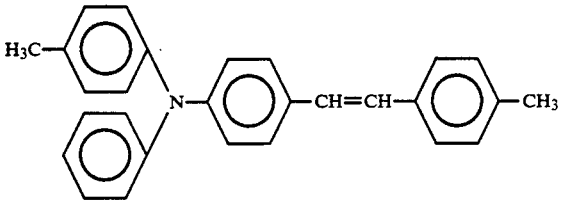
Ip = 5.45 eV -continued
(Compound 2-C)
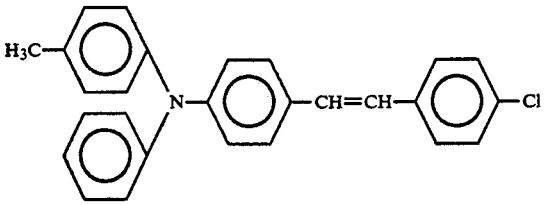
Ip = 5.60 eV
(Compound 2-D)
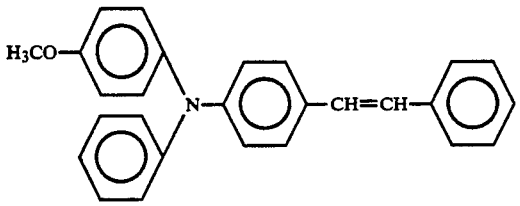
Ip = 5.55 eV
(Compound 2-E)
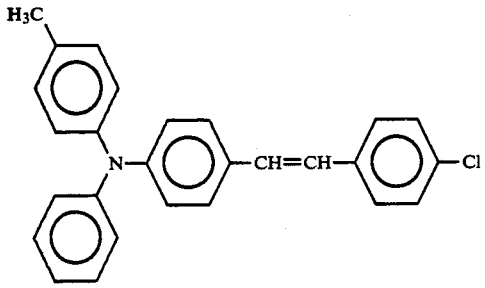
Ip = 5.60 eV
(Compound 2-F)
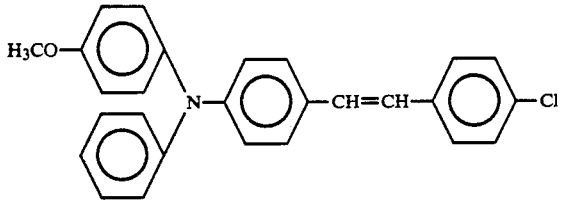
Ip = 5.55 eV
(Compound 2-G)
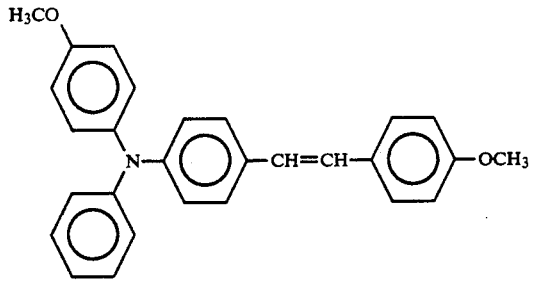
Ip = 5.42 eV
(Compound 2-H)
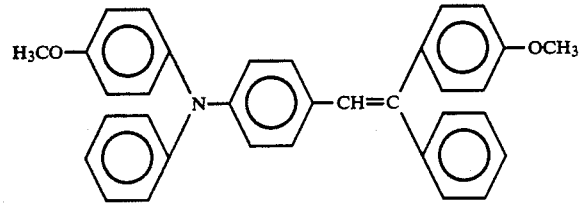
Ip = 5.42 eV -continued
(Compound 2-I)
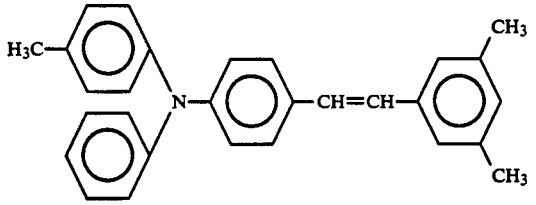
Ip = 5.52 eV
(Compound 2-J)
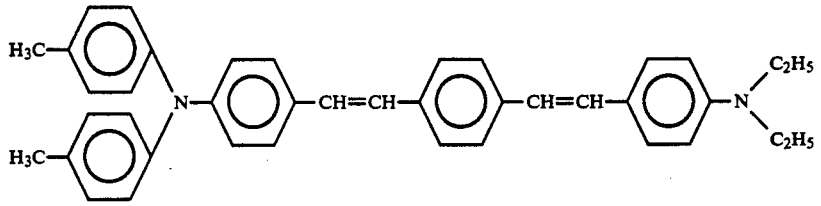
Ip = 5.35 ev
(Compound 2-K)
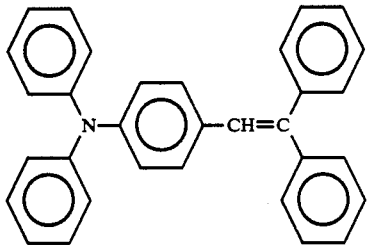
Ip = 5.6 eV
(3) N, N, N', N'-Tetraphenylbenzidine Compound
(Compound 3-A)
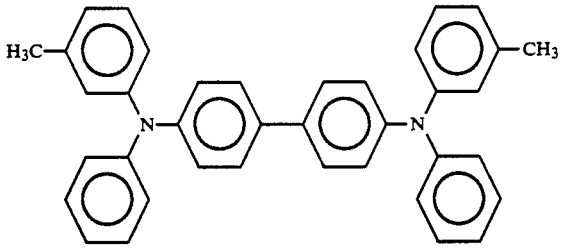
Ip = 5.37 eV
(Compound 3-B)
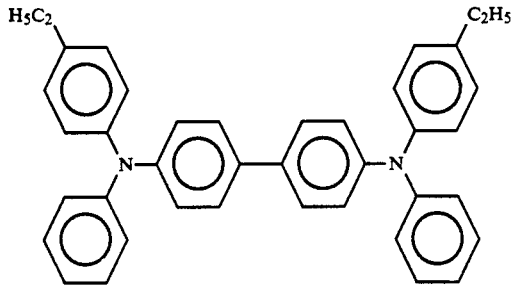
Ip = 5.30 eV -continued
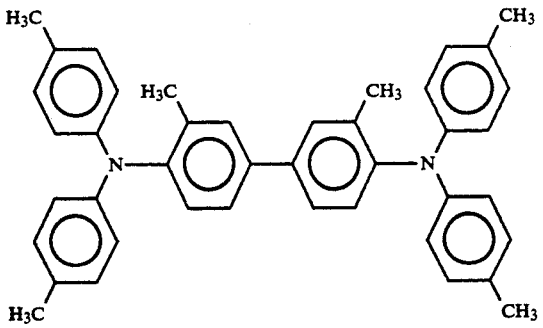
Ip = 5.55 eV
(Compound 3-C)
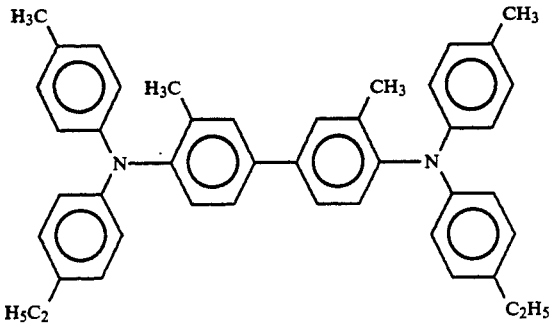
Ip = 5.47 eV
(Compound 3-D)
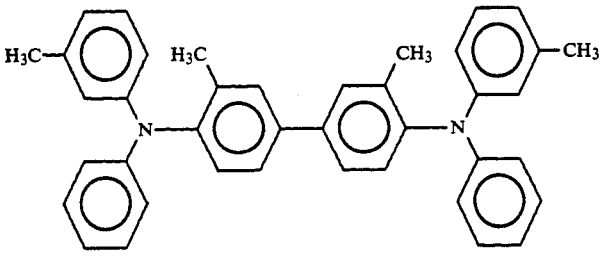
Ip = 5.70 eV
(Compound 3-E)
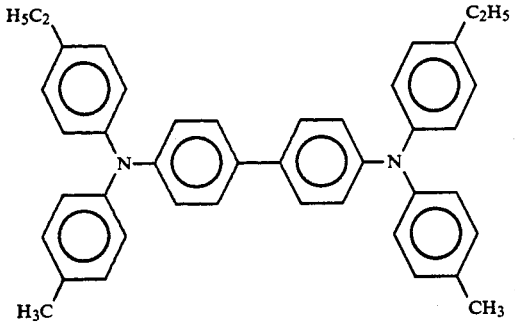
Ip = 5.19 eV
(Compound 3-F)
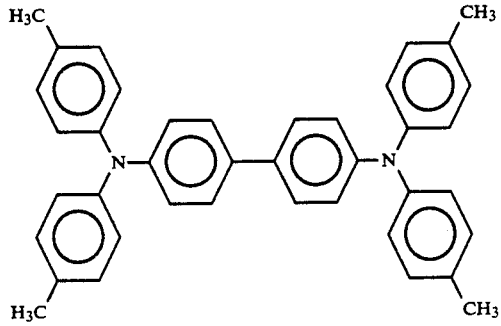
Ip = 5.4 eV
(Compound 3-G)

-continued
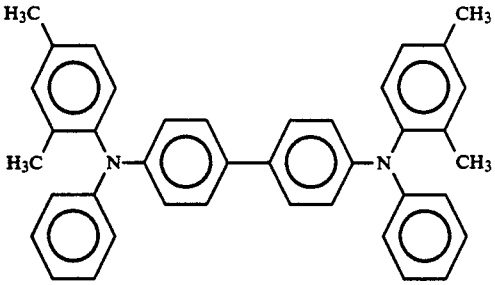
(Compound 3-H)
Ip = 5.43 eV
(4) Other Compound
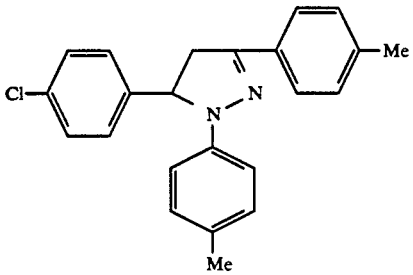
(Compound 4-A)
Ip = 5.63 eV
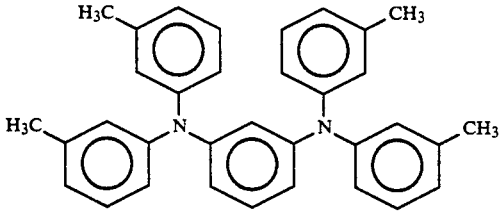
(Compound 4-B)
Ip = 5.63 eV
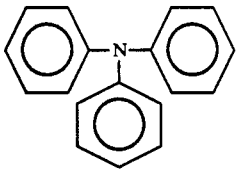
(Compound 4-C)
Ip = 5.74 eV
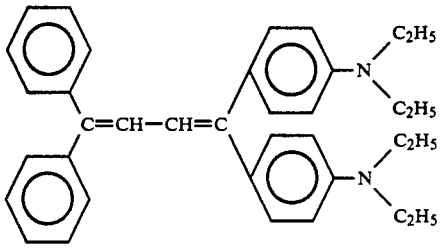
(Compound 4-D)
Ip = 5.32 eV -continued (Compound 4-E)

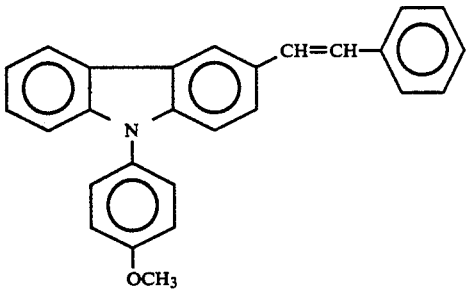

Ip = 5.77 eV (Compound 4-F)

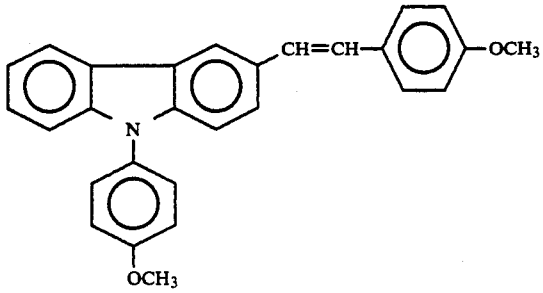

Ip = 5.72 eV

Any of known binder resins may be used in the charge transporting layer. Examples of the binder resins include polycarbonate, polyarylate, polyester, polystyrene, a styrene-acrylonitrile copolymer, polysulfone, polymethacrylates, and a styrene-methacrylic ester copolymer.

In the first aspect of the present invention, it is essential that the charge transporting material having a higher ionization potential should be present in an amount equimolar to or in an amount less than an equimolar amount to the other charge transporting material having a lower ionization potential. In other words, the upper limit of the proportion of the charge transporting material having a higher ionization potential is 50 mol % based on the total amount of the two charge transporting materials. If the amount of the charge transporting material of higher ionization potential exceeds 50 mol %, the photoreceptor suffers from considerable increases in exposure potential and residual potential on long-term repeated use. The lower limit of the amount of the charge transporting material of higher ionization potential is preferably at least 5 mol % based on the total amount of the two charge transporting materials. If it is less than 5 mol %, the photoreceptor tends to cause an image blur on long-term repeated use.

In the second and third aspect of the present invention, the difference between the highest ionization potential and the lowest ionization potential of the transporting materials must be not more than 0.4 eV. If it exceeds 0.4 eV, an increase in residual potential upon repeated use becomes significant resulting in fogging of the resulting image.

Further, in the second and third aspect of the present invention, the amount of the first charge transporting material must be at least 60 wt % based on the total amount of the charge transporting materials. If it is less than 60 wt %, decrease in photosensitivity due to the mutual trapping, decrease in mechanical strength due to the insufficient molar compatibility, and the like problems arise.

It is considered from the above that the use of the first charge transporting material is effective to improve the electrophotographic properties.

In the present invention, the combination of the charge transporting materials, in which the ionization potential of the second charge transporting material is higher than the ionization potential of the charge generating material by at least 0.2 eV, can also be used (third aspect of the present invention).

The weight ratio of the charge transporting materials to the binder resin is preferably from 10/1 to 1/5.

The charge transporting layer usually has a thickness of from 5 to 70 μm, preferably from 10 to 50 μm.

If desired, the photoreceptor of the present invention may have a subbing layer provided on the conductive substrate. The subbing layer functions to block charge injection from the conductive substrate to the charge generating layer at the time of charging and also serves as an adhesive layer for holding the charge generating layer or charge transporting layer on the conductive substrate. In some cases, the subbing layer has a function of preventing reflection of light from the conductive substrate.

Examples of the materials for the subbing layer include known resins, such as polyethylene, polypropylene, acrylic resins, methacrylic resins, polyamide resins, vinyl chloride resins, vinyl acetate resins, phenolic resins, polycarbonate resins, polyurethane resins, polyimide resins, vinylidene chloride resins, polyvinyl acetal resins, vinyl chloride-vinyl acetate copolymers, polyvinyl alcohol, water-soluble polyesters, nitrocellulose, casein, and gelatin.

The subbing layer may be formed of an organozirconium compound, such as a zirconium chelate compound or a zirconium alkoxide, or a silane coupling agent. Examples of the zirconium compounds include tetraacetylacetonatozirconium, zirconium tetrabutoxide, and acetylacetonatotributoxyzirconium. Examples of the silane coupling agents include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, and β-3,4-epoxycyclohexylethyltrimethoxysilane.

Where a photoreceptor is charged by means of an ozone-generating corona discharger (e.g., a corotron), the ozone flow contacts the uppermost layer of the photoreceptor to cause an image blur. Since the charge transporting material having a relatively high ionization potential as used in the present invention is insusceptible to oxidation, it is considered to have resistance against oxidation with the ozone flow to prevent an image blur. On the other hand, such a charge transporting material of high ionization potential is apt to trap charges in the charge transporting layer to induce an increase in residual potential. Accordingly, the charge transporting material having a relatively high ionization potential should be used in a relatively low proportion in the total charge transporting materials.

The formation of an electrostatic latent image on an electrophotographic photoreceptor according present invention can be practiced by the following manners:

The electrophotographic photoreceptor can be charged with a corona discharger, e.g., a corotron. A corotron generally comprises a tungsten wire stretched between two insulator blocks, and generates corona discharge by applying a voltage between the both ends of the tungsten wire. An ion stream generated by the corona discharge is accumulated on the surface of photoreceptor so that the photoreceptor is charged. In order to concentrate the ion stream on the surface of photoreceptor, the tungsten wire is shielded with an insulated material, such as aluminum plate, providing one opening positioned near the surface of photoreceptor.

Another means for charging the photoreceptor include a discharger called scorotron. Charging with a scorotron is advantageous when the photoreceptor is negatively charged in a uniform manner. A scorotron generally comprises the above corotron having plurality of grid wires at the opening, and by applying a prescribed grid voltage, charge controlling can be effected with the prescribed voltage as a threshold value. The non-uniformity of corona discharge particularly in negative charge can be improved by employing the grid wires. It is known that when a corotron is used for negative charge, ozone generates in a larger amount than the case where a corotron is used for positive charge.

The absolute value of the initial charge potential of the photoreceptor in the charging step is generally from 300 to 1,000 V, preferably from 500 to 800 V.

The charged photoreceptor is then imagewise exposed to light so as to form an electrostatic latent image on the surface of photoreceptor. The exposure can be effected by using a conventional optical system composed of a light source and lens so that the photoreceptor is exposed to a light reflected from an original copy. The photoreceptor can also be exposed to a light corresponding to image information data previously converted to electric digital signals. In the latter case, the means of exposure include a laser scanning optical system composed of a semiconductor laser, an imaging lens system and a polygonal mirror, as well as an image bar such as an LED array, a liquid crystal light bulb and a vacuum fluorescent tube head. The resolving power of the image can be selected from a range of from 200 to 600 spi (spot per inch).

The present invention is now illustrated in greater detail with reference to Examples, but it should be understood that the present invention is not construed as being limited thereto. All the parts and percents are by weight unless otherwise indicated.

EXAMPLE 1

A coating composition described below was dip coated on an aluminum pipe and dried at 150° C. for 10 minutes to form a subbing layer having a thickness of 0.1 μm.

| Subbing Layer Coating Composition: | |
|---|---|
| 50% Toluene solution of acetylacetonato-tributoxyzirconium ("ZL 540" produced by Matsumoto Kosho) | 100 parts |
| -Aminopropyltrimethoxysilane ("A 1110" produced by Nippon Unicar Co., Ltd.) | 11 parts |
| Isopropyl alcohol | 440 parts |
| n-Butyl alcohol | 220 parts |

The following components were dispersed in an attritor for 24 hours.

| | |
|---|---|
| Granular trigonal selenium | 87 parts |
| Vinyl chloride-vinyl acetate copolymer ("VMCH" produced by Union Carbide) | 13 parts |
| n-Butyl acetate | 200 parts |

Thirty parts of the resulting dispersion were diluted with 57 parts of n-butyl acetate to prepare a coating composition for a charge generating layer. The composition was dip coated on the subbing layer and dried at 100° C. for 10 minutes to form a charge generating layer having a thickness of 0.1 μm.

A coating composition described below was then dip coated on the charge generating layer and dried at 120° C. for 60 minutes to form a charge transporting layer having a thickness of 25 μm.

| Charge Transporting Layer Coating Composition: | |
|---|---|
| Polycarbonate Z resin | 15 parts |
| Benzidine compound (1) (see Table 1) (Ionization potential: 5.37 eV) | 7.5 parts |
| Benzidine compound (2) (see Table 2) (Ionization potential: 5.47 eV) | 2.9 parts |
| Monochlorobenzene | 100 parts |

EXAMPLE 2

An electrophotographic photoreceptor was prepared in the same manner as in Example 1, except for using the following coating composition for the charge transporting layer.

| Charge Transporting Layer Coating Composition: | |
|---|---|
| Polycarbonate Z resin | 15 parts |
| Benzidine compound (1) | 9.5 parts |
| Benzidine compound (2) | 0.58 part |
| Monochlorobenzene | 100 parts |

COMPARATIVE EXAMPLE 1

An electrophotographic photoreceptor was prepared in the same manner as in Example 1, except for using the following coating composition for the charge transporting layer.

| Charge Transporting Layer Coating Composition: | |
|---|---|
| Polycarbonate Z resin | 15 parts |
| Benzidine compound (1) | 2.5 parts |
| Benzidine compound (2) | 8.7 parts |
| Monochlorobenzene | 100 parts |

COMPARATIVE EXAMPLE 2

An electrophotographic photoreceptor was prepared in the same manner as in Example 1, except for using the following coating composition for the charge transporting layer.

| Charge Transporting Layer Coating Composition: | |
|---|---|
| Polycarbonate Z resin | 15 parts |
| Benzidine compound (1) | 10 parts |
| Monochlorobenzene | 100 parts |

COMPARATIVE EXAMPLE 3

An electrophotographic photoreceptor was prepared in the same manner as in Example 1, except for using the following coating composition for the charge transporting layer.

| Charge Transporting Layer Coating Composition: | |
|---|---|
| Polycarbonate Z resin | 15 parts |
| Benzidine compound (1) (Ionization potential: 5.37 eV) | 75 parts |
| Benzidine compound (3) (see Table 1) (Ionization potential: 5.19 eV) | 2.8 parts |
| Monochlorobenzene | 100 parts |

COMPARATIVE EXAMPLE 4

An electrophotographic photoreceptor was prepared in the same manner as in Example 1, except for using the following coating composition for the charge transporting layer.

| Charge Transporting Layer Coating Composition: | |
|---|---|
| Polycarbonate Z resin | 15 parts |
| Benzidine compound (2) | 11.6 parts |
| Monochlorobenzene | 100 parts |

EXAMPLE 3

A coating composition described below was dip coated on an aluminum pipe and dried at 180° C. for 10 minutes to form a subbing layer having a thickness of 0.1 μm.

| Subbing Layer Coating Composition: | |
|---|---|
| 50% Toluene solution of acetylacetonato-tributoxyzirconium ("ZL 540") | 90 parts |
| -Methacryloxypropyltrimethoxysilane | 11 parts |

-continued

| Subbing Layer Coating Composition: | |
|---|---|
| ("KBM 503" produced by Shin-Etsu Chemical Industry Co., Ltd.) | |
| Isopropyl alcohol | 400 parts |
| n-Butyl alcohol | 200 parts |

The following components were dispersed in a sand mill using glass beads (diameter: 1 mm) as a grinding medium for 30 minutes.

| | |
|---|---|
| Polyvinyl butyral ("BM-1" produced by Sekisui Chemical Co., Ltd.) | 1 part |
| Dibromoanthanthorone (C.I. Pigment Red 168) | 19 parts |
| Cyclohexanone | 8 parts |
| Trifluoroacetic acid | 0.02 part |

Twenty-eight parts of the resulting dispersion were diluted with 62 parts of cyclohexanone to prepare a coating composition. The composition was dip coated on the subbing layer and dried at 100° C. for 10 minutes to form a charge generating layer having a thickness of 0.8 μm.

A coating composition shown below was then dip coated on the charge generating layer and dried at 120° C. for 60 minutes to form a charge transporting layer having a thickness of 20 μm.

| Charge Transporting Layer Coating Composition: | |
|---|---|
| Polycarbonate Z resin | 15 parts |
| Benzidine compound (4) (see Table 1) (Ionization potential: 5.30 eV) | 7.5 parts |
| Benzidine compound (2) (Ionization potential: 5.47 eV) | 2.8 parts |
| Monochlorobenzene | 100 parts |

COMPARATIVE EXAMPLE 5

An electrophotographic photoreceptor was prepared in the same manner as in Example 3, except for using the following coating composition for the charge transporting layer.

| Charge Transporting Layer Coating Composition: | |
|---|---|
| Polycarbonate Z resin | 15 parts |
| Benzidine compound (4) | 10 parts |
| Monochlorobenzene | 100 parts |

Each of the electrophotographic photoreceptors obtained in the foregoing Examples and Comparative Examples was mounted on a copying machine (a reformed model of "FX-2700" manufactured by Fuji Xerox Co., Ltd.) and tested for image quality and electrical characteristics on repeated use. The copying machine used was equipped with an initial charger and a transfer charger, each comprising a shielding element having a U-shaped cross section with an insulating block on both ends thereof over which a tungsten corotron wire was set up. The grid voltage of the corotron charger was set at −800 V, and the exposure was so adjusted to give an exposure potential of −100 V in the initial stage. The charging and exposure processing was repeated at 20° C. and 40% RH. The results obtained are shown in Table 3 below.

TABLE 3

| | Charge transporting material | | | | Image blur | Electrical characteristics at the 10,000th copying | |
|---|---|---|---|---|---|---|---|
| | Compound (I) | | Compound (II) | | | | |
| | Kind | Amount (mol %) | Kind | Amount (mol %) | after obtaining 10,000 copies | Change of exposure potential | Change of residual potential |
| | (1) | 75 | (2) | 25 | not observed | +30 | +10 |
| Example 2 | (1) | 95 | (2) | 5 | not observed | +25 | +10 |
| Comparative Example 1 | (1) | 25 | (2) | 75 | not observed | +105 | +80 |
| Comparative Example 2 | (1) | 100 | — | — | observed | +15 | ±0 |
| Comparative Example 3 | (1) (3) | 75 25 | — | — | observed | +35 | +10 |
| Comparative Example 4 | — | — | (2) | 100 | not observed | +140 | +120 |
| Example 3 | (4) | 75 | (2) | 25 | not observed | -5 | +10 |
| Comparative Example | (4) | 100 | — | — | observed | +15 | −5 |

The results in Table 3 prove that the electrophotographic photoreceptors according to the present invention show improvements in terms of image blur and change in residual potential or exposure potential on repeated use. It is seen, to the contrary, that the residual potential and exposure potential greatly increase on repeated use where the proportion of the benzidine compound (II) exceeds 50 mol % as in Comparative Example 1 or where only the benzidine compound (II) is used as a charge transporting material as in Comparative Example 4.

EXAMPLES 4 TO 9 AND COMPARATIVE EXAMPLES 6 TO 11

Formation of Subbing Layer

A coating composition described below was dip coated on an aluminum pipe having a diameter of 84 mm and dried at 100° C. for 5 minutes to form a subbing layer having a thickness of 0.2 μm.

| | |
|---|---|
| 50% Toluene solution of acetylacetonato-tributoxyzirconium ("ZL 540" produced by Matsumoto Kosho) (weight ratio of acetylacetonato-tributoxyzirconium to toluene: 1/1) | 100 parts |
| -Aminopropyltrimethoxysilane $H_2NC_3H_6Si(OCH_3)_3$ ("A 1110" produced by Nippon Unicar Co., Ltd.) | 11 parts |
| Ethyl alcohol | 600 parts |
| n-Butyl alcohol | 150 parts |

Formation of Charge Generating Layer (1)

The following components were dispersed in an attritor for 48 hours.

| | |
|---|---|
| Granular trigonal selenium | 87 parts |
| Vinyl chloride-vinyl acetate copolymer ("VMCH" produced by Union Carbide) | 13 parts |
| n-Butyl acetate | 200 parts |

Thirty parts of the resulting dispersion were diluted with 57 parts of n-butyl acetate to prepare a coating composition for a charge generating layer. The composition was dip coated on the subbing layer and dried at 100° C. for 5 minutes to form a charge generating layer having a thickness of 0.1 μm.

Formation of Charge Generating Layer (2)

| | |
|---|---|
| x-Type metal-free phthalocyanine | 2.0 parts |
| Polyvinyl butyral resin ("S-Lec BM-1" produced by Sekisui Chemical Co., Ltd.) | 3.0 parts |
| n-Butyl acetate | 45.0 parts |

The above components were put in a ball mill and milled for 20 hours by using SUS balls (diameter: ⅛ inch) as a milling medium. 50 parts of n-butyl acetate was further added thereto, followed by stirring, to prepare a coating composition for a charge generating layer. The composition was dip coated on the subbing layer and dried to form a charge generating layer having a thickness of 0.5 μm.

Formation of Charge Generating Layer (3)

| | |
|---|---|
| Diburomoanthoanthorone pigment (C.I. Pigment Red 168) | 8 parts |
| Polyvinyl butyral resin ("S-Lec BM-1" produced by Sekisui Chemical Co., Ltd.) | 1 parts |
| Cyclohexanone | 19 parts |

The above components were mixed. The mixture was then put in a sand mill and dispersed by using glass beads (diameter: 1 mm) as a dispersing medium. Cyclohexanone was further added thereto to prepare a coating composition having a solid concentration of 10 wt %. The composition was dip coated on the subbing layer and dried at 100° C. for 10 minutes to form a charge generating layer having a thickness of 0.8 μm.

Formation of Charge Transporting Layer

Ten parts in total of the charge transporting material(s) shown in Table 4 below and 10 parts of polycarbonate Z resin were dissolved in 80 parts of monochlorobenzene to prepare a coating composition for the charge transporting layer. The composition was coated on the charge generating layer and dried at 100° C. for 60 minutes to form a charge transporting layer having a thickness of 25 μm, so as to produce electrophotographic photoreceptors.

The charge generating materials and charge transporting materials used and the amounts thereof are shown in Table 4. The charge generating material is represented by "CGM" and the kind of CGM is represented by the above-mentioned numbers of the charge generating layers. The charge transporting materials are represented by "CTM1", "CTM2" and "CTM3". The proportion of CTM1 is represented in terms of the percent by weight based on the total weight of CTM1, CTM2 and CTM3. The difference between the highest ionization potential and the lowest ionization potential of the transporting materials is represented by ΔIp.

TABLE 4

| | CGM | Ip of CGM (eV) | CTM1 | Ip of CTM1 (eV) | CTM2 | Ip of CTM2 (eV) | CTM3 | Ip of CTM3 (eV) | Proportion of CTM1 (wt %) | ΔIp (eV) |
|---|---|---|---|---|---|---|---|---|---|---|
| Example 4 | (1) | 5.80 | 3-D | 5.47 | 3-A | 5.37 | — | — | 70 | 0.10 |
| Example 5 | (1) | 5.80 | 2-G | 5.42 | 2-C | 5.60 | — | — | 70 | 0.18 |
| Exampel 6 | (2) | 5.40 | 1-G | 5.28 | 1-F | 5.35 | — | — | 60 | 0.07 |
| Example 7 | (2) | 5.40 | 3-A | 5.37 | 4-B | 5.63 | — | — | 70 | 0.26 |
| Example 8 | (3) | 5.44 | 3-H | 5.43 | 3-E | 5.70 | 4-E | 5.72 | 60 | 0.29 |
| Example 9 | (3) | 5.44 | 3-A | 5.37 | 4-E | 5.77 | — | — | 70 | 0.40 |
| Comparative Example 6 | (1) | 5.80 | 3-A | 5.37 | 3-C | 5.55 | — | — | 50 | 0.18 |
| Comparative Example 7 | (1) | 5.80 | 3-E | 5.70 | 3-F | 5.19 | — | — | 70 | 0.51 |
| Comparative Example 8 | (2) | 5.40 | 3-A | 5.37 | — | — | — | — | 100 | — |
| Comparative Example 9 | (2) | 5.40 | 1-G | 5.28 | 1-F | 5.35 | — | — | 50 | 0.07 |
| Comparative Example 10 | (2) | 5.40 | 3-C | 5.55 | 1-A | 5.23 | — | — | 70 | 0.32 |
| Comparative Example 11 | (3) | 5.44 | 3-D | 5.47 | 3-A | 5.37 | 3-C | 5.55 | 60 | 0.18 |

Each of the electrophotographic photoreceptors obtained in the foregoing Examples and Comparative Examples was mounted on a copying machine ("VIVACE 500" manufactured by Fuji Xerox Co., Ltd.) and charged in such a manner that the dark part potential (charged potential) $V_D$ was −800 V and the white part potential $V_L$ was −150 V. The electrophotographic photoreceptor was subjected to the durability test of 100,000 copies, and the dark part potential $V_D$ and the white part potential $V_L$ were measured. The initial residual potential, the residual potential after the durability test, and the amount of wear of the charge transporting layer after the durability test were also measured. The results are shown in Table 5 below.

The quality of the image obtained after the durability test was also evaluated. In Examples 4 to 9, clear images with sufficient image density and free of fogging in a white part were stably obtained. In Comparative Examples 6 to 11, the images obtained suffered fogging.

TABLE 5

| | $V_D$ after durability test (V) | $V_L$ after durability test (V) | Residual potential: Initial (V) | Residual potential: After durability test (V) | Wear amount of transporting layer after durability test (μm) |
|---|---|---|---|---|---|
| Example 4 | 760 | 190 | 80 | 130 | 3.2 |
| Example 5 | 770 | 210 | 80 | 150 | 3.6 |
| Example 6 | 770 | 220 | 180 | 250 | 3.3 |
| Example 7 | 780 | 160 | 190 | 220 | 3.4 |
| Example 8 | 790 | 180 | 60 | 100 | 3.2 |
| Example 9 | 770 | 170 | 70 | 100 | 2.9 |
| Comparative Example 6 | 700 | 400 | 70 | 210 | 3.5 |
| Comparative Example 7 | 730 | 380 | 60 | 190 | 3.8 |
| Comparative Example 8 | 710 | 400 | 180 | 300 | 3.7 |
| Comparative Example 9 | 740 | 350 | 170 | 280 | 3.6 |
| Comparative Example 10 | 720 | 390 | 160 | 400 | 3.9 |
| Compartive Example 11 | 700 | 390 | 60 | 250 | 3.9 |

As described and demonstrated above, the electrophotographic photoreceptor according to the present invention settles down the problems occurring on repeated use, i.e., an image blur, an increase in residual potential, and an increase in exposure potential, and exhibits excellent electrophotographic characteristics on long-term repeated use.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon a photosensitive layer as the uppermost layer, said photosensitive layer comprising at least a first charge transporting material dissolved together in said photosensitive layer with a second charge transporting material, said second charge transporting material having an ionization potential 0.2 to 0.4 eV higher than the ionization potential of said first material and said second material being present in an amount equimolar to or in an amount less than the equimolar amount of said first charge transporting material.

2. An electrophotographic photoreceptor as claimed in claim 1, wherein said second charge transporting material having a higher ionization potential is present in an amount of from 5 to 50 mol % based on the total of said first and second charge transporting materials.

3. An electrophotographic photoreceptor as claimed in claim 1, wherein said first charge transporting material comprising a benzidine compound represented by formula (I):

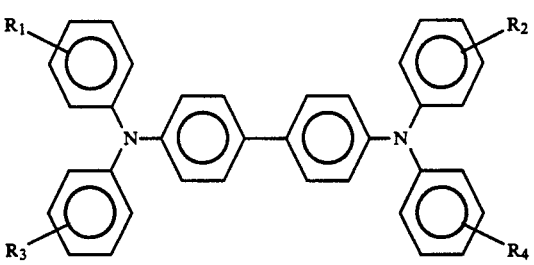

(I)

wherein $R_1$, $R_2$, $R_3$, and $R_4$ each represent a hydrogen atom, an alkyl group, an alkoxy group, a halogen atom, an alkoxycarbonyl group, or a substituted amino group, and said second charge transporting material comprises a benzidine compound represented by formula (II):

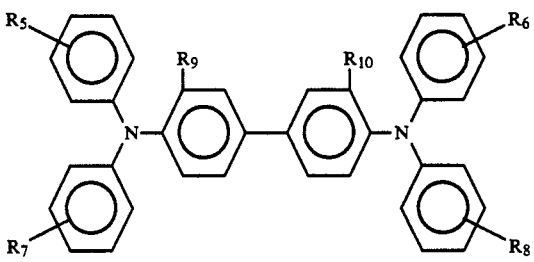

(II)

wherein $R_5$, $R_6$, $R_7$, and $R_8$ each represent a hydrogen atom, an alkyl group, an alkoxy group, a halogen atom, an alkoxycarbonyl group, or a substituted amino group; and $R_9$ and $R_{10}$ each represent an alkyl group or an alkoxy group.

4. A method for forming an electrostatic latent image on an electrophotographic photoreceptor, said method comprising the steps of:

charging an electrophotographic photoreceptor comprising a conductive substrate having thereon a photosensitive layer as the uppermost layer, said photosensitive layer comprising at least a first charge transporting material dissolved together in said photosensitive layer with a second charge transporting material, said second charge transporting material having a higher ionization potential than the ionization potential of said first material and said second material being present in an amount equimolar to or in an amount less than the equimolar amount of said first charge transporting material, by means of an ozone-generating discharger; and imagewise exposing the charged photoreceptor to light.

5. A method as claimed in claim 4, wherein said first charge transporting material is present in an amount of from 5 to 50 mol % based on the total of said first and second charge transporting materials.

6. A method as claimed in claim 4, wherein said first charge transporting material comprises a benzidine compound represented by formula (I):

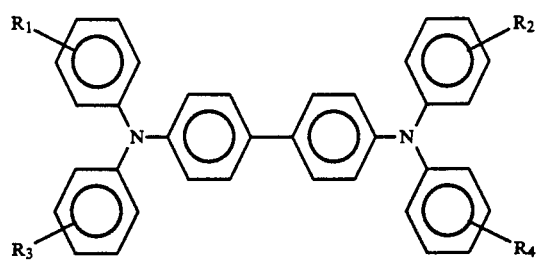

(I)

wherein $R_1$, $R_2$, $R_3$, and $R_4$ each represent a hydrogen atom, an alkyl group, an alkoxy group, a halogen atom, an alkoxycarbonyl group, or a substituted amino group, and the second charge transporting material comprises a benzidine compound represented by formula (II):

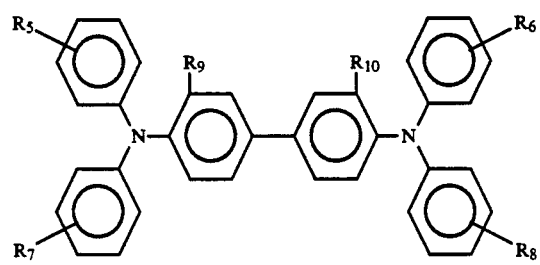

(II)

wherein $R_5$, $R_6$, $R_7$, and $R_8$ each represent a hydrogen atom, an alkyl group, an alkoxy group, a halogen atom, an alkoxycarbonyl group, or a substituted amino group; and $R_9$ and $R_{10}$ each represent an alkyl group or an alkoxy group.

7. A laminate type electrophotographic photoreceptor comprising a conductive substrate having thereon a charge generating layer and a charge transporting layer, said charge generating layer comprising a binder resin and a charge generating material dispersed therein, said charge transporting layer comprising a binder resin and at least two charge transporting materials dissolved together in said charge transporting layer and comprising a first charge transporting material and a second charge transporting material, said second transporting material having a higher ionization potential than said second charge transporting material, the amount of said first charge transporting material being at least 60 wt % based on the total amount of said charge transporting materials, the difference in ionization potential between the second charge transporting material and the first charge transporting material being not more than 0.4 eV, the ionization potential of said first charge transporting material being lower than the ionization potential of said charge generating material, the ionization potential of said second charge transporting material being higher than the ionization potential of said charge generating material by at least 0.2 eV.

8. A laminate type electrophotographic photoreceptor as claimed in claim 7, wherein said second charge transporting material having a higher ionization potential is present in an amount from 5 to 50 mol percent based on the total of said two first and second charge transporting materials.

9. A laminate type electrophotographic photoreceptor as claimed in claim 7, wherein said first charge transporting material comprises a benzidene compound represented by formula (I):

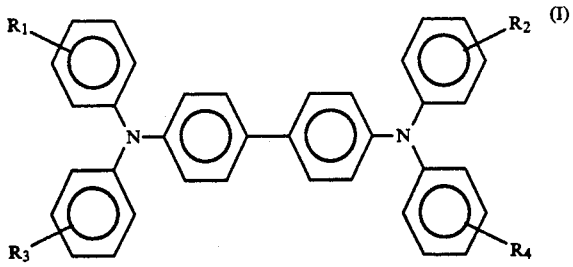

(I)

wherein $R_1$, $R_2$, $R_3$, and $R_4$ each represents a hydrogen atom, an alkyl group, an alkoxy group, a hydrogen atom, an alkoxycarbonyl group, or a substituted amino group, and said second charge transporting material comprises a benzidene compound represented by formula (II):

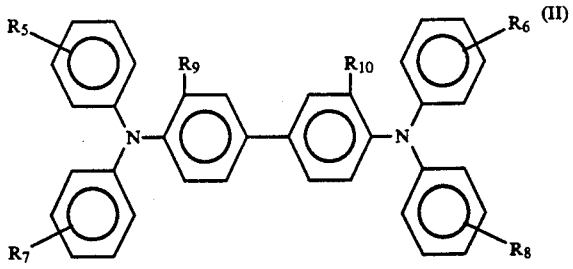

(II)

wherein $R_5$, $R_6$, $R_7$ and $R_8$ each represents a hydrogen atom, an alkyl group, an alkoxy group, a hydrogen .oup, an alkoxycarbonyl group or a substituted amino group; and $R_9$ and $R_{10}$ each represents an alkyl group or an alkoxy group.

* * * * *